US010520967B2

(12) United States Patent
Nomura et al.

(10) Patent No.: US 10,520,967 B2
(45) Date of Patent: Dec. 31, 2019

(54) POWER CONVERTER WITH A BOOST UNIT INCLUDING AT LEAST TWO BOOST CHOPPER CIRCUITS CONNECTED IN PARALLEL

(71) Applicant: OMRON Corporation, Kyoto (JP)

(72) Inventors: Kosuke Nomura, Shiga (JP); Kenji Kobayashi, Shiga (JP); Kotaro Nakamura, Shiga (JP)

(73) Assignee: OMRON Corporation, Kyoto (JP)

( * ) Notice: Subject to any disclaimer, the term of this patent is extended or adjusted under 35 U.S.C. 154(b) by 65 days.

(21) Appl. No.: 15/720,402

(22) Filed: Sep. 29, 2017

(65) Prior Publication Data

US 2018/0150096 A1 May 31, 2018

(30) Foreign Application Priority Data

Nov. 29, 2016 (JP) ..... 2016-231173

(51) Int. Cl.
*G05F 1/66* (2006.01)

(52) U.S. Cl.
CPC ..... *G05F 1/66* (2013.01)

(58) Field of Classification Search
None
See application file for complete search history.

(56) References Cited

U.S. PATENT DOCUMENTS 8,058,752 B2 * 11/2011 Erickson, Jr. ..... G05F 1/67 307/150
8,559,201 B2 * 10/2013 Fujii ..... H02H 7/122 323/266
8,670,257 B2 * 3/2014 Hiramatsu ..... H02M 1/12 363/97
8,773,876 B2 * 7/2014 Kuboyama ..... H02M 7/487 363/132
9,164,525 B2 * 10/2015 Erickson, Jr. ..... G05F 1/67
2014/0003093 A1 * 1/2014 Song ..... H02M 7/483 363/13
2014/0111172 A1 4/2014 Sasao et al.
2016/0111959 A1 * 4/2016 Erickson, Jr. ..... G05F 1/67 136/252
2016/0126742 A1 * 5/2016 Ayai ..... H02J 3/383 307/82
2017/0229978 A1 * 8/2017 Ayai ..... H02M 3/155
2017/0264099 A1 * 9/2017 Zhang ..... H02M 7/44

FOREIGN PATENT DOCUMENTS

JP 2006-340442 A 12/2006
JP 2014-087185 A 5/2014
JP 2015-136202 A 7/2015

* cited by examiner

*Primary Examiner* — Jue Zhang
*Assistant Examiner* — Henry E Lee, III
(74) *Attorney, Agent, or Firm* — Osha Liang LLP

(57) ABSTRACT

A power converter capable of minimizing the amount of fluctuation in the input power value to the boost circuit when changing the number of operating circuits and the switching frequency; when reducing the number of boost chopper circuits operating and the switching frequency the controller reduces the duty cycle of the PWM signal to a circuit to be halted while said circuit scheduled for halt operates, whereafter the controller halts operation of said circuit scheduled for halt and changes the switching frequency to a frequency corresponding to the state determination value.

7 Claims, 17 Drawing Sheets

POWER CONVERTER WITH A BOOST UNIT INCLUDING AT LEAST TWO BOOST CHOPPER CIRCUITS CONNECTED IN PARALLEL

TECHNICAL FIELD

The present invention generally relates to a power conversion device.

BACKGROUND

Devices equipped with multiple chopper circuits connected in parallel may serve as power converters as described in for example, in Japanese Patent Publication Numbers JP 2006-340442, JP 2014-87185, JP 2015-136202. A power converter may also change the number of chopper circuits operating (hereafter, number of operating circuits) and the switching frequency depending on the situation (e.g., the load current, or the like).

SUMMARY

The inventors carefully researched the above-mentioned type of power converter in order to develop a high-performing power conditioner for use with solar panels. This diligent research revealed that the input power value (and particularly the input current value) to the chopper circuit in the above-mentioned type of power conditioner fluctuated to a relatively large extent when reducing the number of operating circuits. The inventors also discovered that the input power value (and particularly the input voltage value) fluctuated to a relatively large extent when increasing the number of operating circuits and decreasing the switching frequency.

It is more likely that MPPT control may be negatively affected when the input power value to the chopper circuit fluctuates to a large extent. Even with no MPPT control being performed, elements inside the chopper circuit may be damaged when the input power value changes suddenly. Accordingly, a power converter may be provided with a plurality of boost chopper circuits connected in parallel with the power converter changing the number of operating circuits and the switching frequency in accordance with the situation; the input power value to the chopper circuit in this kind of power converter may be small when the number of operating circuits and the switching frequency changes.

Therefore, one or more embodiments of the present invention provide a power converter equipped with a plurality of boost chopper circuits connected in parallel with the power converter changing the number of operating circuits and the switching frequency in accordance with the situation, and the power converter capable of reducing the amount of fluctuation in the input power value to the chopper circuit when the number of operating circuits change.

A power converter according to one or more embodiments of the present invention include: a boost unit including N boost chopper circuits connected in parallel, where N≥2; and a controller configured to operate the boost chopper circuits within the boost unit via a PWM signal, the controller changing the number of boost chopper circuits operating and a switching frequency which is the frequency of the PWM signal in accordance with a state determination value indicating an input power value to the boost unit or an output power value from the boost unit. When reducing the number of boost chopper circuits operating and the switching frequency the controller reduces the duty cycle of the PWM signal to a circuit to be halted while said circuit scheduled for halt operates, whereafter the controller halts operation of said circuit scheduled for halt and changes the switching frequency to a frequency corresponding to the state determination value.

That is, a power converter according to one or more embodiments of the present invention reduces the duty cycle of a PWM signal prior to actually stopping operation of the circuit scheduled for halt while allowing the circuit scheduled for halt to continue operating for a predetermined time. If the circuit scheduled for halt operates in this manner, no sudden changes occur in the input power value (mainly the input current value) sent to the boost chopper circuit that continues operating. Accordingly, one or more embodiments of the present invention reduce the amount of fluctuation in the input power value to the chopper circuit when changing (reducing) the number of operating circuits.

The results of further careful research by the present inventors also proved that when increasing the number of operating circuits and the switching frequency, the input power value to the chopper circuit fluctuates to a large extent if the boost chopper circuit that is operating transitions from a continuous current power mode to a discontinuous current power mode. The present inventors also discovered the advantage of supplying the boost chopper circuit with a pulse where the width thereof is between the pulse width prior to changing the frequency and the pulse width after changing the frequency for one or more pulses when changing the switching frequency (i.e., the frequency of the PWM signal); namely, supplying such a pulse when changing the frequency reduces the amount of fluctuation in the input power value that accompanies changing the pulse width compared to changing the pulse width suddenly.

Therefore, to prevent a large fluctuation in the input power value to the boost chopper circuit when increasing the number of operating circuits and the switching frequency a power converter according to one or more embodiments of the present invention includes a controller that performs the following function. More specifically, the controller: defines an increment threshold as a state determination value which ensures that the other boost chopper circuits that are operating do not transition from a continuous current power mode to a discontinuous current power mode even when an individual boost chopper circuit begins operating, and maintains an increment threshold separately for the number of boost chopper circuits that are operating; and changes the switching frequency to a frequency corresponding to the state determination value and begins operating a halted boost chopper circuit when the state determination value is greater than or equal to the increment threshold corresponding to the number of boost chopper circuits that are operating.

A power converter according to one or more embodiments of the present invention includes: a boost unit including N boost chopper circuits connected in parallel, where N≥2; and a controller configured to operate the boost chopper circuits within the boost unit via a PWM signal, the controller changing the number of boost chopper circuits operating and a switching frequency which is the frequency of the PWM signal in accordance with a state determination value indicating an input power value to the boost unit or an output power value from the boost unit. The controller: defines an increment threshold as a state determination value which ensures that the other boost chopper circuits that are operating do not transition from a continuous current power mode to a discontinuous current power mode even when an individual boost chopper circuit begins operating, and maintains an increment threshold separately for the number of boost chopper circuits that are operating; and changes the switching frequency to a frequency corresponding to the state determination value and begins operating a halted boost chopper circuit when the state determination value is greater than or equal to the increment threshold corresponding to the number of boost chopper circuits that are operating.

That is, the power converter according to one or more embodiments is configured to ensure that a boost chopper circuit that is operating does not transition from a continuous current power mode to a discontinuous current power mode when the number of operating circuits and the switching frequency increases. Accordingly, one or more embodiments of the present invention reduce the amount of fluctuation in the input power value to the chopper circuit when changing (increasing) the number of operating circuits.

Finally, to reduce the amount of fluctuation in the input power value that accompanies changing the pulse width, a power converter according to any of the one or more embodiments of the present invention may be configured to control the pulse width. More specifically, the controller may control the pulse width of a PWM signal prior to changing the switching frequency so that for a limited time the width of the pulse is between the pulse width of the PWM signal prior to changing the frequency and a pulse width of the PWM signal after changing the frequency.

Embodiments of the present invention may provide a power converter equipped with a plurality of boost chopper circuits connected in parallel with the power converter changing the number of operating circuits and the switching frequency in accordance with the situation, and the power converter capable of reducing the amount of fluctuation in the input power value entered into the chopper circuit when the number of operating circuits change.

DETAILED DESCRIPTION

One or more embodiments of the invention are described below with reference to the drawings. Note that the one or more embodiments described herein are merely examples and the present invention is not limited to the configurations in these embodiments.

Figure 1:
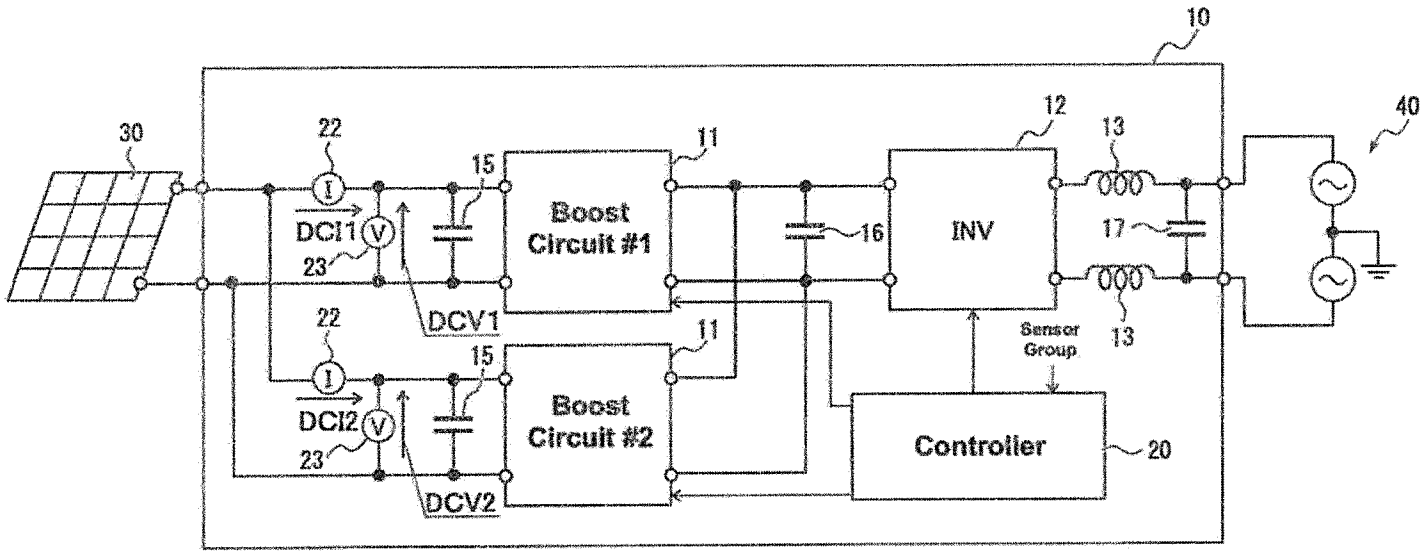
FIG. 1 is for describing an overall configuration and an application of a power converter according to one or more embodiments of the invention.
Figure 2:
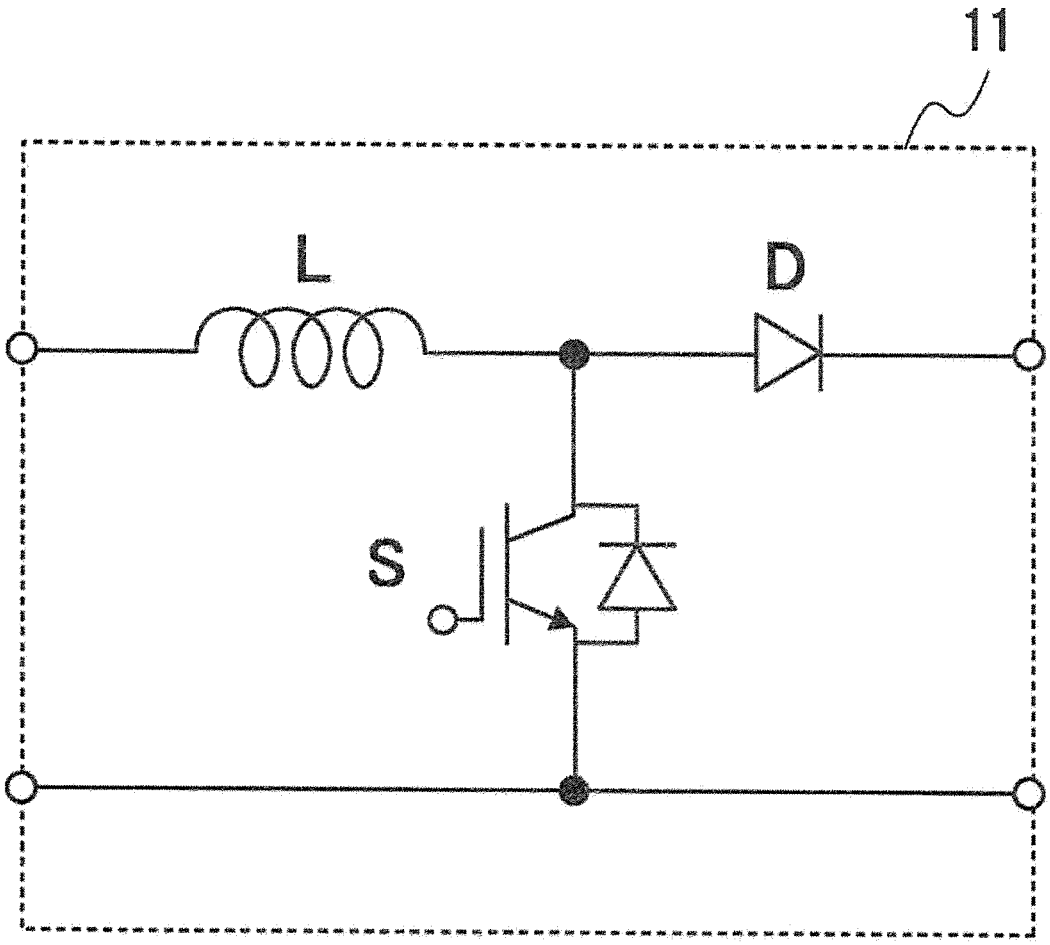
FIG. 2 illustrates a configuration of a boost circuit within the power converter according to one or more embodiments.

First, a power converter 10 according to one or more embodiments is outlined with reference to FIG. 1 and FIG. 2. FIG. 1 outlines a configuration and an application of the power converter 10 according to one or more embodiments, and FIG. 2 illustrates a configuration of a boost circuit 11 used in the power converter 10.

As illustrated in FIG. 1, the power converter 10 is connected to solar cells 30 and a power line 40 (i.e., a power conditioner), and is provided with boost circuits 11, an inverter 12 (INV), and a controller 20. The two boost circuits 11 in the power converter 10 are referred to below as the boost circuit #1 and the boost circuit #2.

The boost circuits 11 (boost circuit #1, #2) provided to the power converter 10 are ordinary boost chopper circuits. That is, each of the boost circuits 11 are made up of an inductor (L), a switching element (S), and a diode (D) as illustrated in FIG. 2. The diode arranged between the source and the drain of the switching element S (IGBT in FIG. 2) is what is known as a commutation diode.

As illustrated in FIG. 1, a pair of input terminals in each of the boost circuits 11 is connected to a pair of input terminals in the power converter 10. A pair of output terminals in each of the boost circuits 11 is connected to a pair of input terminals in the inverter 12. That is, the two boost circuits 11 in the power converter 10 are connected in parallel. The power converter 10 uses the portions of the two boost circuits 11 connected in parallel to boost the voltage output from the solar cells 30 and supplies the boosted voltage to the inverter 12. Hereafter the portions of the two boost circuits 11 connected in parallel is referred to as the boost unit.

The inverter accepts direct current from the boost unit and converts the same into alternating current power at 50 Hz or 60 Hz. As illustrated in the drawings, each of the output terminals in the inverter 12 are connected to a specific output terminal in the power converter 10 via the inductor 13 which is used for smoothing.

A capacitor 15 is placed between the pair of input terminals in each of the boost circuits 11 in the power converter 10. A capacitor 16 is placed between the pair of input terminals of the inverter 12 (between the pair of output terminals in the boost unit), and another capacitor 17 is placed between the pair of output terminals of the power converter 10.

The power converter 10 is provided with a current sensor 22 and a voltage sensor 23 for measuring an input current value DCI1 and an input voltage DCV1 to the boost circuit #1. The power converter 10 is also provided with a current sensor 22 and a voltage sensor 23 for measuring an input current value DCI2 and an input voltage DCV2 to the boost circuit #2. Although not illustrated, the power converter 10 is also provided with other current sensors and voltage sensors at various locations therein.

The controller 20 is a module for controlling the two boost circuits 11 and the inverter 12 in the power converter 10. The controller 20 is made up of a processor (a CPU, a micro controller, or the like), a gate driver, and the like. As illustrated, the output of the various sensors, e.g., sensors 22, 23 enter the controller 20.

The functions of the controller are described below. Note that the controller 20 manages the inverter 12 in the same manner that a controller within an ordinary power conditioner controls an inverter. Therefore, the functions of the controller 20 are described below mainly in terms of controlling the boost unit (i.e. the two boost circuits 11).

Usually the controller 20 carries out any of the following two processes:

- a two-circuit operation process which supplies the boost circuit #1 with a PWM signal at a two-circuit frequency f2, and supplies the boost circuit #2 with a PWM signal at a two-circuit frequency f2 phase-shifted 180° from the aforementioned PWM signal; and
- a single-circuit operation process which supplies the boost circuit #1 with a PWM signal at a single-circuit frequency f1 that is lower than the two-circuit frequency, while not operating the boost circuit #2.

During each of the operation processes, the controller 20 adjusts (i.e., changes) the duty ratio (hereafter, referred to as the duty) in order to implement Maximum Power Point Tracking (MPPT) control or the like.

Note that the two-circuit frequency f2 is a predetermined frequency used as a switching frequency (frequency of the PWM signal) when both boost circuits #1, #2 are operating; the single-circuit frequency f1 is a predetermined frequency lower than a two-circuit frequency f2 and is used as the switching frequency when only a single boost circuit 11 is operating (and in one or more embodiments that is the boost circuit #1). In addition, to say "stop operating the boost circuit #2" means that the PWM signal supplied to the boost circuit #2 is a low-level signal, i.e. the duty of the PWM signal is 0%.

In other words, when operating both the boost circuits #1, #2 the controller 20 carries out a two-circuit operation process, and when operating only the boost circuit #1, the controller 20 carries out a single-circuit operation process. However, changing the number of boost circuits 11 that operate (hereafter, number of operating circuits) by simply switching the type of operation process executed leads to large fluctuations in the input power value entering the boost circuits 11 when the number of operating circuits changes. Consequently, the controller 20 is configured to change the number of operating circuits by way of a procedure illustrated in FIG. 3. This operation circuit adjustment process begins in a state where both the boost circuits #1, #2 are operating (i.e., during the two-circuit operation process). That is, the flow illustrated in FIG. 3 of the operation circuit adjustment process omits the steps where the controller 20 manages the solar cells 30 in generating power.

Figure 3:
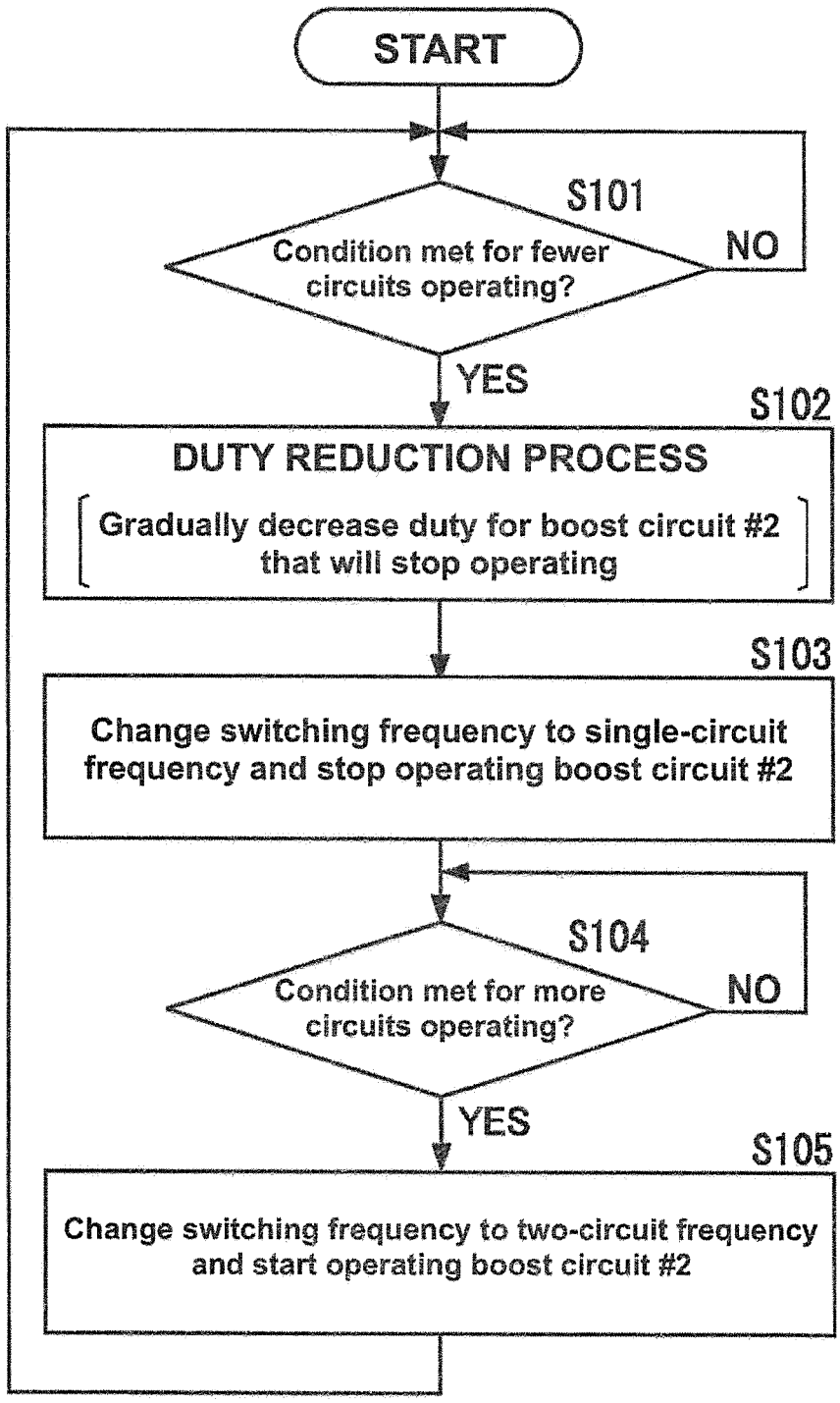
FIG. 3 illustrates the flow of processes executed by a controller within the power converter according to one or more embodiments for changing the number of operating circuits.

As illustrated in FIG. 3, after having started the operation circuit adjustment process, the controller 20 repeats the process in step S101, i.e., the controller 20 monitors whether a condition requiring fewer circuits to operate is met.

The condition indicating that fewer circuits should operate is an assessment of whether a predetermined power test value is less than a reduction threshold; this assessment serves as a condition for reducing the number of operating circuits. The reduction threshold is a predetermined power value; the power test value indicates the amount of power input to and output from the boost unit, e.g., an input power value to the boost unit or an output power value from the boost unit, and the like.

Figure 4A:
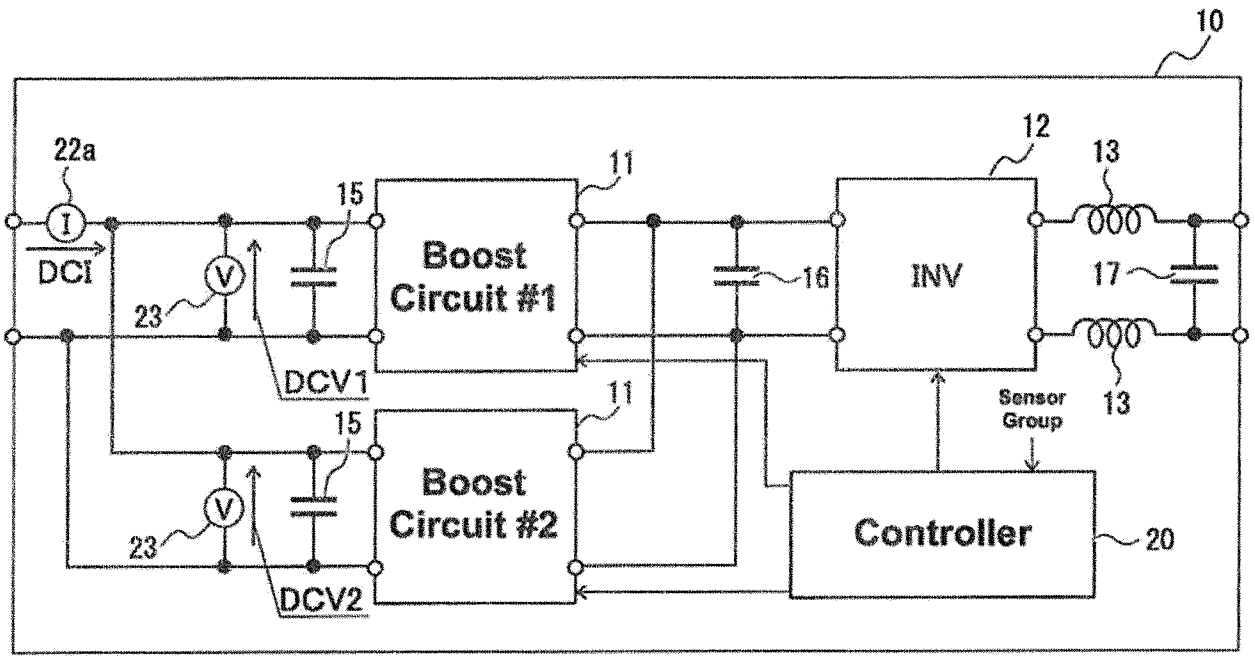
FIG. 4A is for describing a method of calculating a power test value.
Figure 4B:
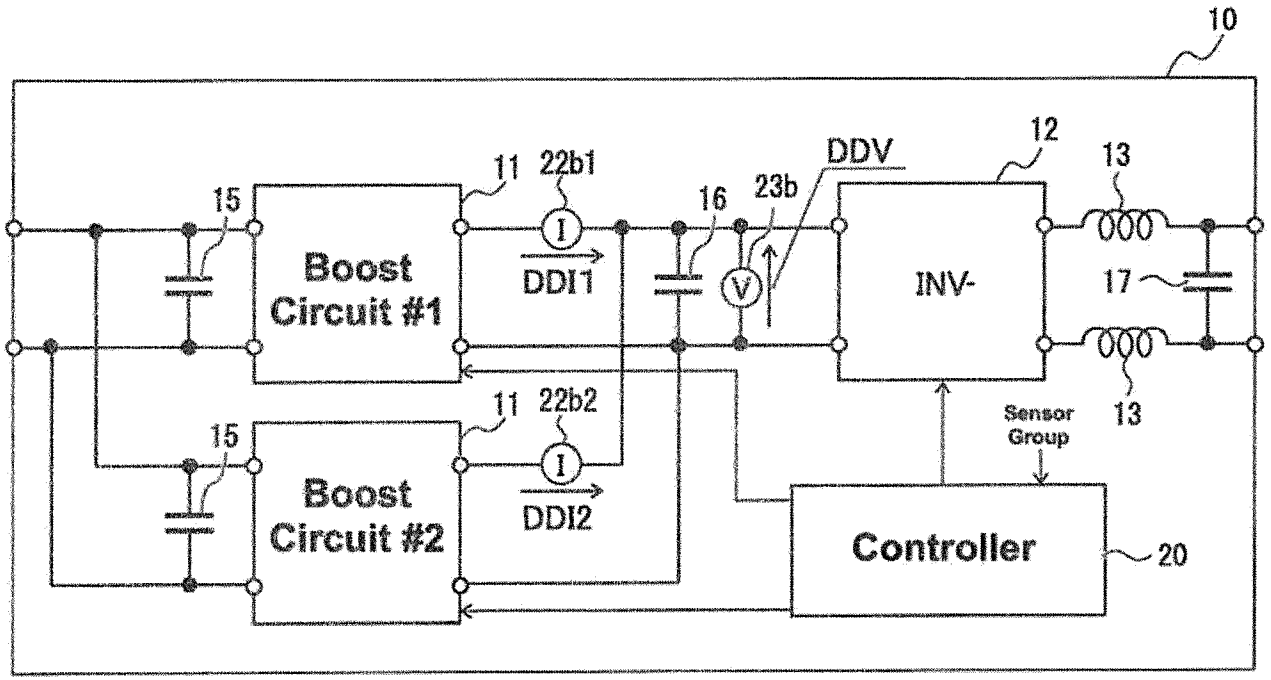
FIG. 4B is for describing a method of calculating a power test value.
Figure 4C:
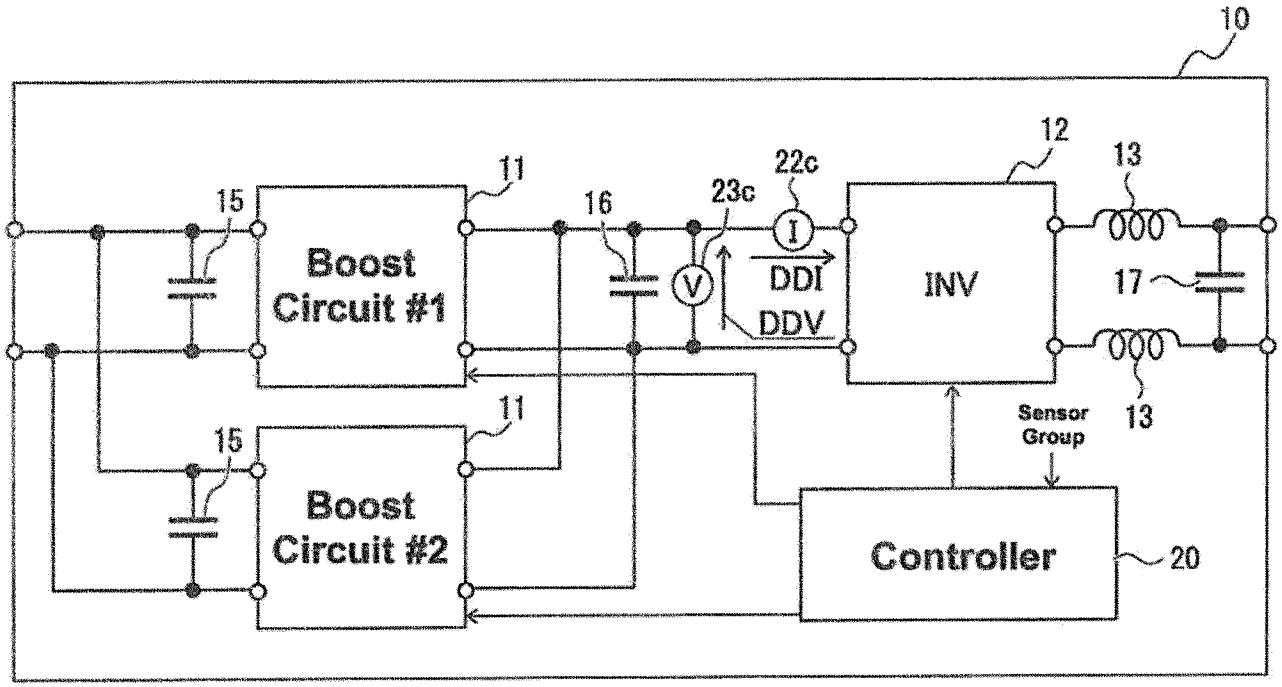
FIG. 4C is for describing a method of calculating a power test value.
Figure 4D:
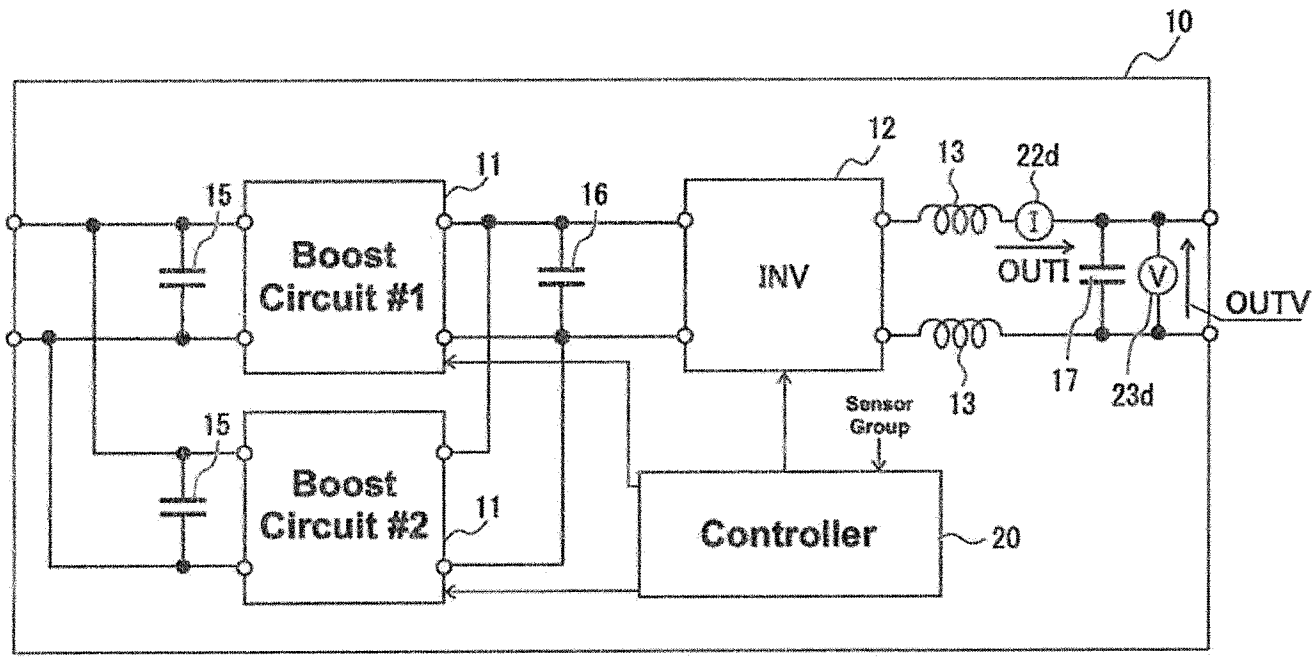
FIG. 4D is for describing a method of calculating a power test value.

The formula: DCI1×DCV1+DCI2×DCV2 (FIG. 1) may be used to obtain an input power value entering the boost unit; this input power value may serve as the power test value. The input power value entering the boost unit may be obtained by via the formula DCI×(DCV1+DCV2)/2 using the input current value DCI1 to the boost unit measured by the current sensors 22 placed at various locations as illustrated in FIG. 4A, and from the input voltage DCV1 to the boost circuit #1, and the input voltage DCV2 to the boost circuit #2. Additionally, when the power test value is the output power value from the boost unit, said output power value may be obtained via the formula (DCI1+DCI2)×DDV; here the output current value DDI1 from the boost circuit #1, the output current value DDI2 from the boost circuit #2, and the input voltage value DDV to the inverter 12 are measured by the current sensor 22*b*1, the current sensor 22*b*2, and the voltage sensor 23*b* placed at various locations as illustrated in FIG. 4B. The output power value from the boost unit may be obtained via the formula: DCI×DDV using the input current value DDI and the input voltage value DDV to the inverter 12 measured by the current sensor 22*c* and the voltage sensor 23*c* placed at various locations as illustrated in FIG. 4C. The output power value from the inverter 12 is thus roughly equal to the output power value from the boost unit. Accordingly, the output power value of the inverter 12 is obtained from the output current value OUTI and the output voltage value OUTV from the inverter 12 measured by the current sensor 22*d* and the voltage sensor 23*d* placed at various locations as illustrated in FIG. 4D. Additionally, the value obtained may be used as the power test value.

When the condition for reducing the number of circuits operating is met (YES, step S101), the controller 20 enters a process for gradually decreasing the duty in step S102.

This duty reduction process gradually decreases the duty of the PWM signal supplied to the boost circuit #2 that will stop operating. Various methods may be adopted for gradually decreasing the duty. For instance, the duty may be reduced to 0% over a fixed period.

Figure 5:
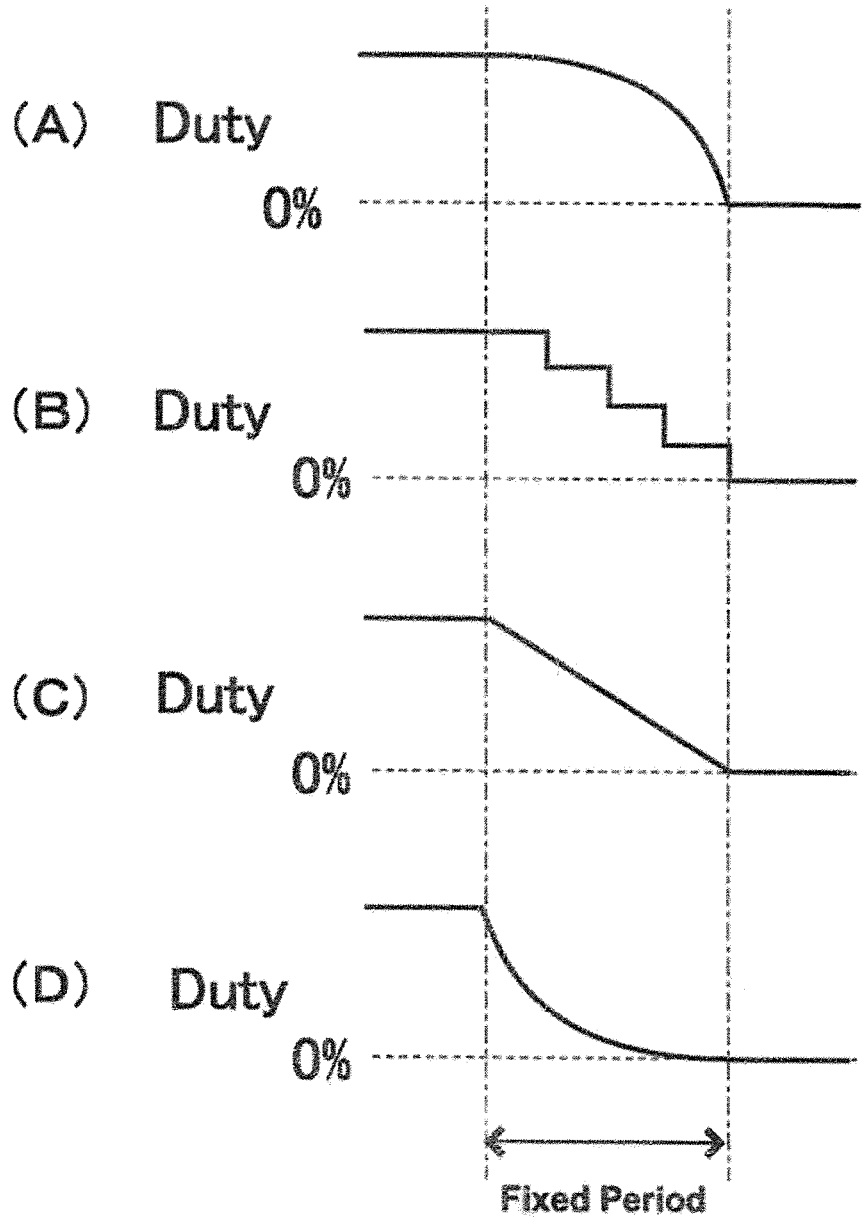
FIG. 5 is for describing the process of reducing the duty ratio.

The time variation pattern used during the duty reduction process is not particularly limited. For instance, the time variation pattern may be established as illustrated in FIG. 5, (A) to (D). That is, the time variation pattern may involve increasing the rate at which duty decreases in accordance with the time elapsed as in FIG. 5(A), or may involve a step-wise reduction in the duty as in FIG. 5(B). The time variation pattern may also involve reducing the duty at a fixed rate as in FIG. 5(C), or lowering the rate of reduction in accordance with the time elapsed as in FIG. 5(D).

Moreover, the process of gradually decreasing the duty may involve changing the fixed period in accordance with an initial duty value (e.g., the smaller the duty at the start of the process, the shorter the fixed period). The process of gradually decreasing the duty may reduce the duty to a value other than 0%. For instance, the process may reduce duty to 5%, or may reduce the duly to 10% of the initial duty value.

Figure 6:
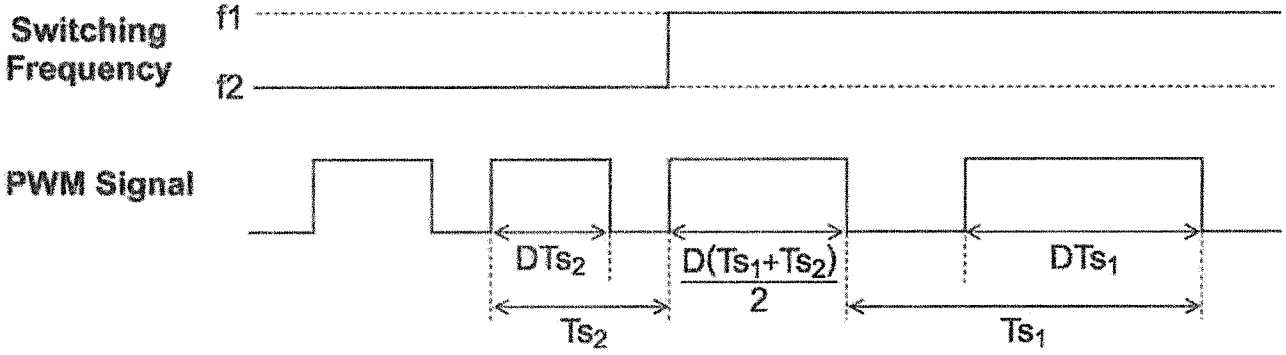
FIG. 6 is for describing a procedure performed by the controller to change the switching frequency when reducing the number of operating circuit.

The controller 20, which has completed the duty reduction process, changes the switching frequency (i.e., the frequency of the PWM signal) to the single-circuit frequency f1 and stops operating the boost circuit #2 (step S103). The controller 20 changes the switching frequency (step S103) in the same manner depicted in FIG. 6. In FIG. 6 and the later described FIG. 8, Ts1 and Ts2 are periods corresponding to frequencies f1, f2 (i.e., inverse of frequencies f1, f2) respectively; D represents the duty (duty cycle).

That is, during the process in step S103 the controller 20 controls the pulse width of the PWM signal so that for a limited period the width of the pulse is between the pulse width DTs2 of the PWM signal prior to changing the frequency and the pulse width DTs1 of the PWM signal after changing the frequency. For instance, in FIG. 6 the pulse width of the PWM signal is the average of DTs1 and DTs2 for the duration of one pulse.

The effects of the processes described thus far are further explained here.

Figure 7:
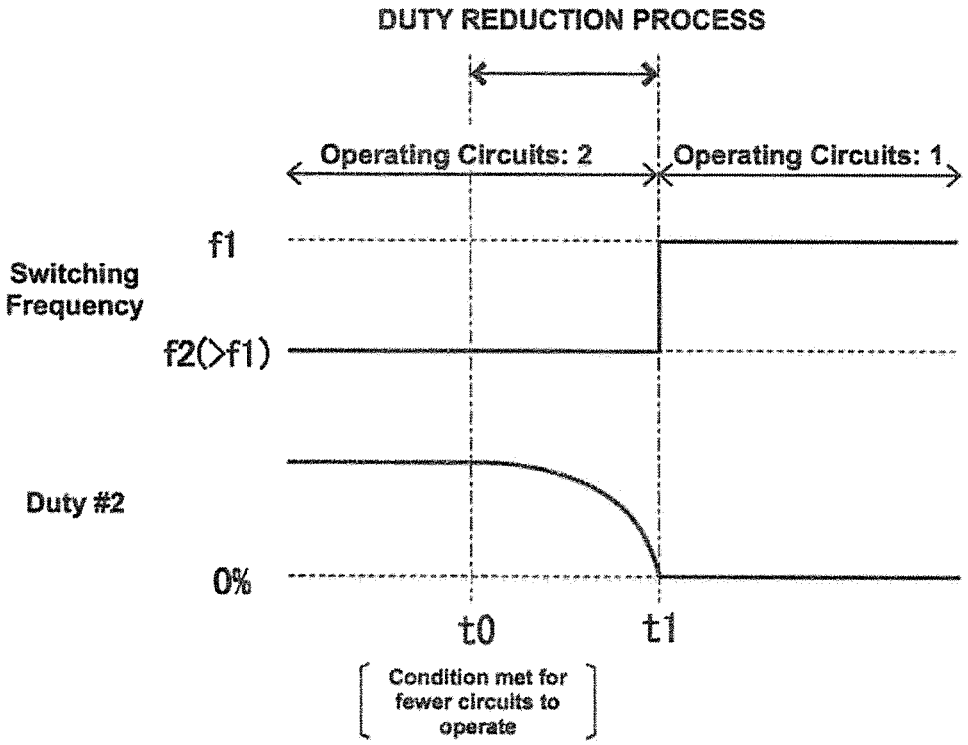
FIG. 7 is for describing a procedure performed by power converter according to one or more embodiments for reducing the number of operating circuits and the switching frequency.

Assume that the condition requiring fewer circuits to operate is met at time t0. In this case, as illustrated in FIG. 7, the duty reduction process begins while the switching frequency is kept at f2. This duty reduction process gradually decreases the duty of the PWM signal supplied to the boost circuit #2. Accordingly, the input power value (mainly the input current value) to the boost circuit #1 increases gradually without any sudden increases during the duty reduction process.

Once the duty reduction process terminates at the time t1, the switching frequency is changed to f1 at the same time that the boost circuit #2 stops operating. The duty may be reduced to 0% (FIG. 7); in this case, the input power value to the boost circuit #1 does not change even when the boost circuit #2 stops operating. The duty may be reduced to a non-zero value; in this case, the input power value to the boost circuit #1 changes because the boost circuit #2 stops operating. However, in this case the amount of change is quite small.

Thus, reducing the number of operating circuits using the above-mentioned procedure prevents a large fluctuation in the input power value to the boost circuit #1 when reducing the number of circuits.

Moreover, the above described procedure controls the pulse width of the PWM signal when changing the switching frequency from f2 to f1 so that for a limited period the width of the pulse is between the pulse width DTs2 of the PWM signal prior to changing the frequency and the pulse width DTs1 of the PWM signal after changing the frequency (FIG. 6). Accordingly, the above-described procedure minimizes the amount of change in the input power value brought about by changing switching frequency (i.e. changing the pulse width).

Returning to FIG. 3, the process of changing the number of operating circuits is further described.

The controller 20, which has completed the process in step S103, now repeats the process in step S104; that is, the controller 20 monitors whether to increase the number of operating circuits. The process of increasing the number of operating circuits is described later in detail.

Figure 8:
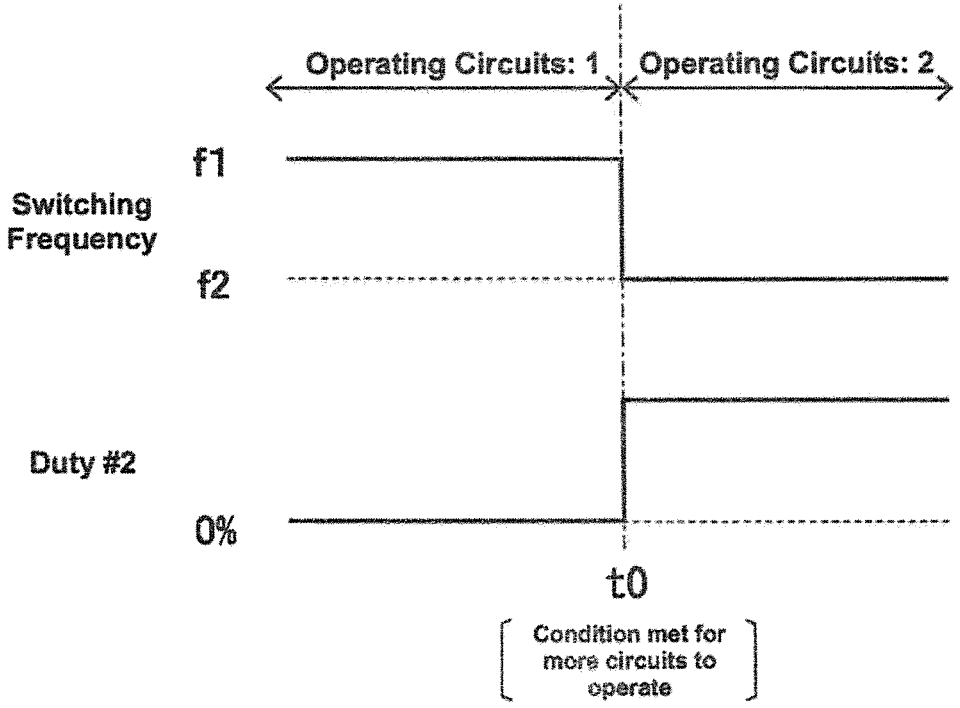
FIG. 8 is for describing a procedure performed by power converter according to one or more embodiments for increasing the number of operating circuits and the switching frequency.

When the condition for increasing the number of operating circuits is met (YES, step S104), the controller 20 changes the switching frequency to the two-circuit frequency f2 and at the same time starts operating the boost circuit #2 (step S105). That is, when the condition for increasing the number of operating circuits is met, the controller 20 changes the switching frequency to the two-circuit frequency f2 and at the same time changes the duty #2 of the PWM signal to the boost circuit #2 from 0% to a value in accordance with the situation at that time, e.g., the input voltage value (FIG. 8).

The controller 20 also changes the switching frequency (step S105) using the same timing in step S103 (FIG. 9) to reduce the amount of fluctuation in the input power value brought about by changing the switching frequency. That is, the controller 20 controls the pulse width of the PWM signal so that the width of the pulse is between the pulse width DTs1 of the PWM signal prior to changing the frequency and the pulse width DTs2 of the PWM signal after changing the frequency. For instance, in FIG. 9 the pulse width of the PWM signal is the average of DTs1 and DTs2 for the duration of one pulse.

The controller 20, which has completed the process in step S105, returns to step S101 and monitors whether to reduce the number of operating circuits (i.e., the controller is in standby).

The process of increasing the number of operating circuits is described below.

The condition indicating that more circuits should operate is an assessment of whether a predetermined power test value is less than an increment threshold; this assessment serves as a condition for increasing the number of operating circuits. As previously described, the power test value represents the amount of power input to and output from the boost unit, e.g., the input power value to the boost unit or the output power value from the boost unit, and the like.

The increment threshold is a predetermined value established to satisfy the following conditions 1 and 2.

Condition 1: the increment threshold is greater than the reduction threshold.

Condition 2: even if the boost circuit #2 begins operating when the power test value equals the increment threshold, the boost circuit #1 does not transition from a continuous current power mode to a discontinuous current power mode.

The first condition is to ensure that the number of operating circuits changes infrequently. The second condition is based on a discovery made by the present inventors through diligently researching power converters equipped with boost circuits connected in parallel; namely, that if the boost circuit #1 transitions from a continuous current power mode to a discontinuous current power mode when increasing the number of operating circuits, the input power value to the boost circuit #1 fluctuates greatly compared to when the boost circuit #1 maintains a continuous current power mode.

That is, even when the duty remains the same the output voltage (boost rate) of the boost circuit 11 differs between the current continuous current power mode and the discontinuous current power mode. Therefore, if the boost circuit #1 transitions from a continuous current power mode to a discontinuous current power mode when increasing the number of operating circuits, the input power value to the boost circuit #1 fluctuates greatly. Accordingly, simply keeping a boost circuit #1 from transitioning from a continuous current power mode can prevent the input power value to the boost circuit #1 from fluctuating when increasing the number of operating circuits. Because adjusting the value of the increment threshold can prevent the boost circuit #1 transitioning from a continuous current power mode to a discontinuous current power mode when increasing the number of operating circuits, the increment threshold is therefore defined to satisfy the second condition.

As above described, the power converter 10 according to one or more embodiments reduces the duty cycle of a PWM signal prior to actually stopping operation of the circuit scheduled for halt (here, boost circuit #2), while allowing the circuit scheduled for halt to continue operating for a predetermined time. If the circuit scheduled for halt operates in this manner, no sudden changes occur in the input power value (mainly the input current value) of the boost circuit 11 that continues operating (here, boost circuit #1). Therefore, the power converter 10 is capable of minimizing the amount of fluctuation in the input power value to the boost circuit when reducing the number of operating circuits and the switching frequency.

The power converter 10 is also able to increase the number of operating circuits (i.e., allow the boost circuit #2 to start operating) at a power value where the boost circuit #1 does not transition from a continuous current power mode to a discontinuous current power mode. Therefore, the power converter 10 is capable of minimizing the amount of fluctuation in the input power value to the boost circuit 11 (boost circuit #1) when increasing the number of operating circuits and the switching frequency.

Moreover, the power converter 10 controls the pulse width of the PWM signal prior to changing the switching frequency (i.e., the frequency of the PWM signal) so that for a limited time the width of the pulse is between a pulse width of the PWM signal prior to changing the frequency and a pulse width of the PWM signal after changing the frequency. Accordingly, the power converter 10 minimizes the amount of fluctuation in the input power value brought about by changing the switching frequency (i.e., changing the pulse width).

One or more embodiments of the power converter is described below focusing on the portions distinct from the power converter 10 according to one or more embodiments.

Figure 10:
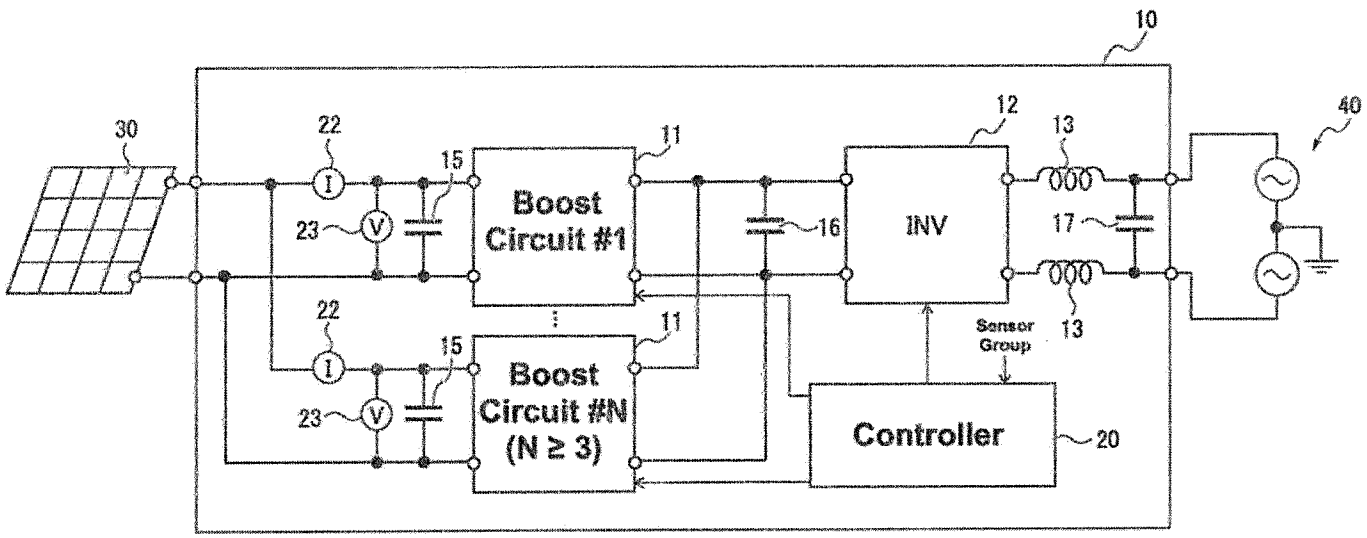
FIG. 10 is for describing an overall configuration and an application of a power converter according to one or more embodiments of the invention.

FIG. 10 depicts an overall configuration and an application of a power converter 10 according to one or more embodiments.

As is clear from FIG. 10, the power converter 10 according to one or more embodiments includes N components made up of a boost circuit 11, a capacitor 15, and the like (where N≥3); the power converter 10 according to one or more embodiments has more components than the power converter 10 of one or more other embodiments. For simplicity, hereafter the power converter 10 according to one or more embodiments and the power converter 10 according to one or more other embodiments are referred to as a first power converter 10 and a second power converter 10 respectively. In addition, the N boost circuits 11 in the second power converter 10 are also referred to below as the boost circuits #1 to #N.

The controller 20 in the second power converter 10 controls each of the boost circuits 11 and the inverter 12 similarly to the controller in the first power converter 10.

However, the controller 20 in the second power converter 10 is configured to select any of 1 through N operating circuits (i.e., the number of boost circuits 11 in operation).

More specifically, when the number of operating circuits m (m is from 1 to N), the controller 20 controls an m-circuit operation process which supplies the boost circuits #1 to #m with PWM signals #1 to #m which are phase-shifted by (360/m)° and where the duty of the PWM signals #(m+1) to #N is 0%. Here, the m-circuit frequency is a predetermined frequency that is used as the switching frequency when m boost circuits 11 are operating. The m-circuit frequency is defined so that the m-circuit frequency increases as the value of m increases. However, for example, just as the single-circuit frequency may equal the two-circuit frequency, and the three-circuit frequency may equal the four-circuit frequency, the rn-circuit frequency may be less than the switching frequency for a total number of N frequencies.

Figure 11:
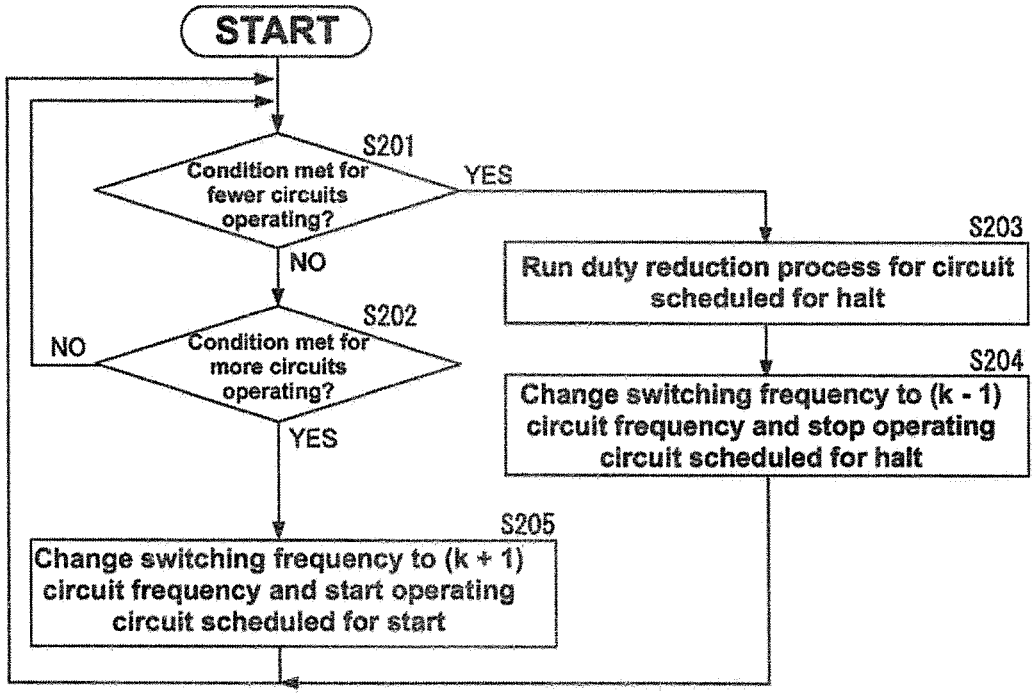
FIG. 11 illustrates the flow of processes executed by a controller within the power converter according to one or e embodiments for changing the number of operating circuits.

The controller 20 also carries out the process illustrated in FIG. 11 to change the number of operating circuits.

That is, the controller 20 which is running the process for changing the number of operating circuits loops through processes in step S201 and step S202 to thereby monitor the condition for decreasing the number of operating circuits or the condition for increasing number of operating circuits (i.e., the controller 20 is in standby).

The condition indicating that fewer circuits should operate is identical to the condition used by the first power converter 10, and is an assessment of whether a predetermined power test value is less than the reduction threshold; the condition indicating that more circuits should operate is identical to the condition used by the first power converter 10 and is an assessment of whether a predetermined value is less than or equal to an increment threshold.

However, in the second power converter 10 the reduction threshold and the increment threshold are defined differently depending on the number of operating circuits. Note that the increment threshold is established to satisfy the following conditions 3, 4 when the number of operating circuits is m (m is from 1 to N), similarly to the first power converter 10.

Condition 3: The increment threshold for m operating circuits is greater than the reduction threshold for m operating circuits.

Condition 4: the boost circuits #1 to #m do not transition from a continuous current power mode to a discontinuous current power mode even when the boost circuit #(m+1) begins to operate when the power test value equals the increment threshold for m operating circuits.

Because the reduction threshold and the increment threshold are thus defined differently for the number of operating circuits, it is possible to determine whether or not the criteria indicating whether fewer circuits should operate is satisfied in step S201 by comparing the reduction threshold corresponding to the number of operating circuits at the time with the power test value. It is also possible to determine whether or not the criteria indicating that more circuits should operate is satisfied in step S202 by comparing the increment threshold corresponding to the number of operating circuits at the time with the power test value.

The number of operating circuits when either criteria of operating fewer circuits or the criteria of operating more circuits is satisfied is represented by k below.

When the criteria for reducing the number of operating circuits is met (YES, step S201), the controller 20 enters a process for gradually decreasing the duty of the boost circuit 11 scheduled for halt in step S203. As is clear from the above-mentioned m-circuit operation process, the second power converter 10 operates boost circuits #1 to #m when the number of operating circuits is m. Therefore, the boost circuit #k is scheduled for halt when the number of operating circuits is determined to be k in step S201.

The controller 20 which has completed the process in step S203, changes the switching frequency to a (k−1) circuit frequency and stops operating the circuit scheduled for halt (i.e., the boost circuit #k). The controller 20 changes the switching frequency in step S204 similarly to changing the switching frequency in step S103 (FIG. 6).

The controller, which has completed the process in step S204, runs a (k−1) circuit operation process and returns to monitoring whether to reduce or to increase the number of operating circuits (i.e., the controller 20 is in standby).

Figure 9:
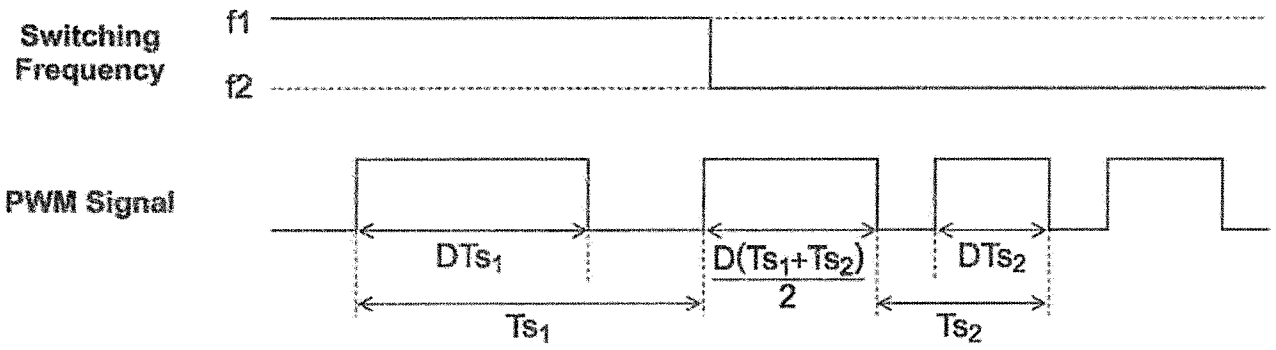
FIG. 9 is for describing a procedure performed by power converter according to one or more embodiments for increasing the switching frequency.

The controller 20 changes the switching frequency to a (k+1) circuit frequency when the condition for increasing the number of operating circuit is met (YES, step S202) and at the same time starts operating a boost circuit 11 (in the figures the "circuit scheduled for start"), which is to start operation (step S205). The controller 20 changes the switching frequency in step S205 similarly to changing the switching frequency in step S105 (FIG. 9).

The controller 20 which has completed the process in step S205, returns to step S201 and runs the (k+1) circuit operation process while monitoring whether to reduce the number of operating circuits (i.e., the controller is in standby).

Although the second power converter 10 includes more boost circuits 11 than the first power converter 10, the second power converter 10 performs the same control as the first power converter 10 when changing the number of operating circuits and the switching frequency. Accordingly, the second power converter 10 is capable of minimizing the amount of fluctuation in the input power value to the boost circuit when changing the number of operating circuits and the switching change (i.e., reducing or increasing the number of operating circuits), and also minimizes the amount of fluctuation in the input power value brought about by changing the switching frequency (i.e., changing the pulse width).

Note that the power test the value may be responsive to the amount of sunlight irradiating the solar cells 30. Accordingly, the power test value may change (decrease or increase) suddenly. For example, the power test value should decrease to the value required for reducing the number of operating circuits to a single operating circuit when the number of operating circuits is N; in this case, the second power converter 10 may be configured to change the number of operating circuits one at a time (FIG. 11). Therefore, the second power converter 10 may still minimize the amount of fluctuation power entering the boost circuit 11 in such a situation.

Figure 12:
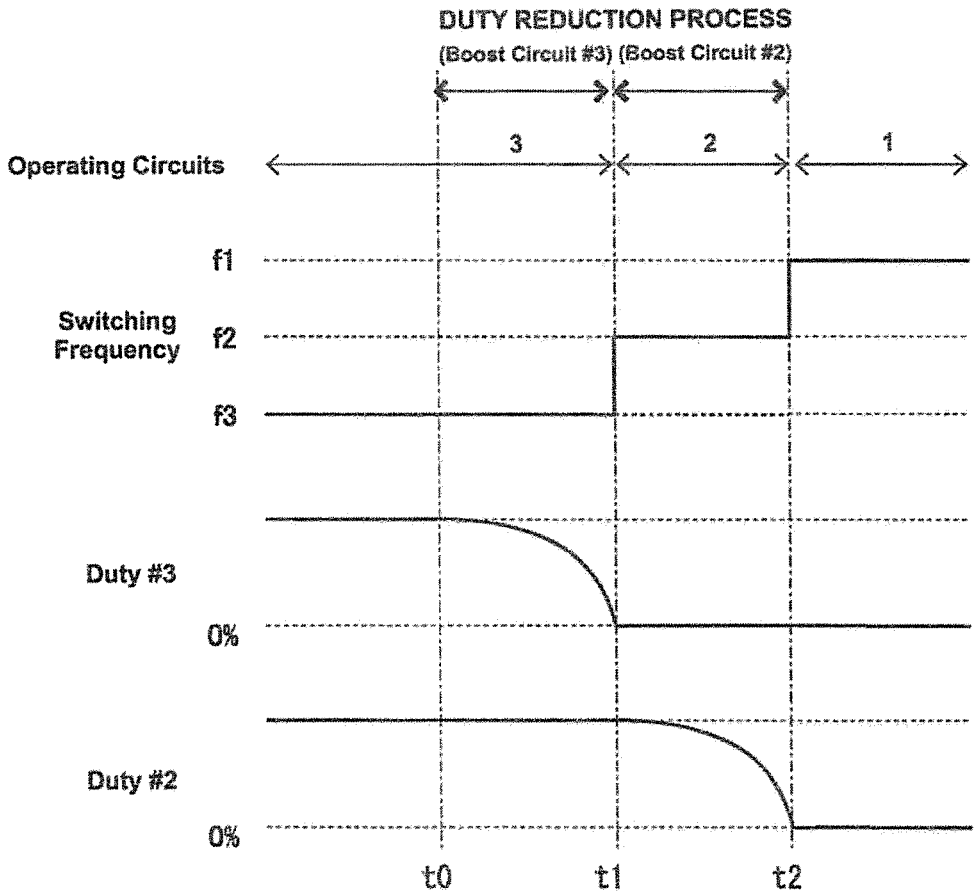
FIG. 12 is for describing a procedure performed by the power converter according to one or more embodiments for reducing the number of operating circuits and the switching frequency.

More specifically, assume that a second power converter includes N=3 boost circuits, that all three circuits are operating, and that the power test value decreases to a value required to reduce the number of operating circuits to a single operating circuit. In this case, as illustrated in FIG. 12 the duty reduction process begins for the boost circuit #3 at time t0 when the power test value decreases, gradually reducing the duty #3 of the PWM signal sent to the boost circuit #3. When the duty reduction process is complete for the boost circuit #3, the switching frequency changes from a three-circuit frequency f3 to a two-circuit frequency f2. Thereafter, while at this point in one or more other embodiments, it is evaluated whether or not the condition for operating fewer circuits is met, in the above-mentioned case, it is determined that the condition for operating fewer circuits is met. Therefore, the duty reduction process begins for the boost circuit #2 when the switching frequency changes completely to the two-circuit frequency f2 (at the time t1) to gradually reduce the duty #2 of the PWM signal sent to the boost circuit #2. When the duty reduction process is complete for the boost circuit #2, the switching frequency changes from a two-circuit frequency f2 to a single-circuit frequency f1.

The second power converter 10 uses the above-mentioned kind of procedure to reduce the number of operating circuits to a single operating circuit. When there is a need to increase the number of operating circuits by two or more circuits, the second power converter 10 may similarly increase the number of operating circuits one at a time. Accordingly, the second power converter 10 is capable of minimizing the amount of fluctuation in the power entering the boost circuits 11 when the power test value changes suddenly compared to other procedures used for changing the number of operating circuits and that the switching frequency.

Possible Modifications

Figure 13:
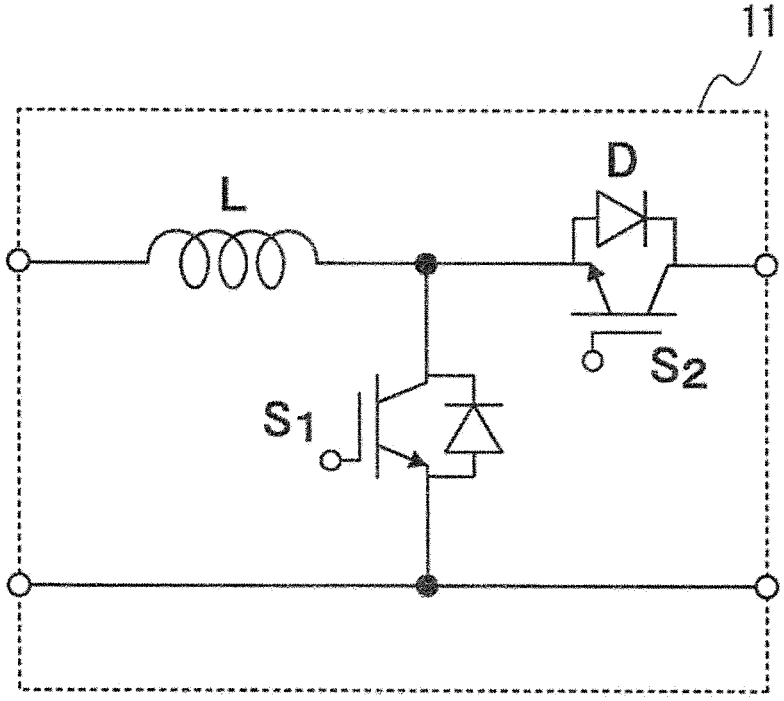
FIG. 13 illustrates a consideration of a chopper circuit that may be used as the boost circuit.

A power converter 10 according to one or more embodiments may be modified in various ways. For example, a power converter 10 according to one or more embodiments may be a DC-DC converter. The power converter 10 may adopt a two-way chopper circuit (FIG. 13) to function as a boost circuit 11.

Figure 14:
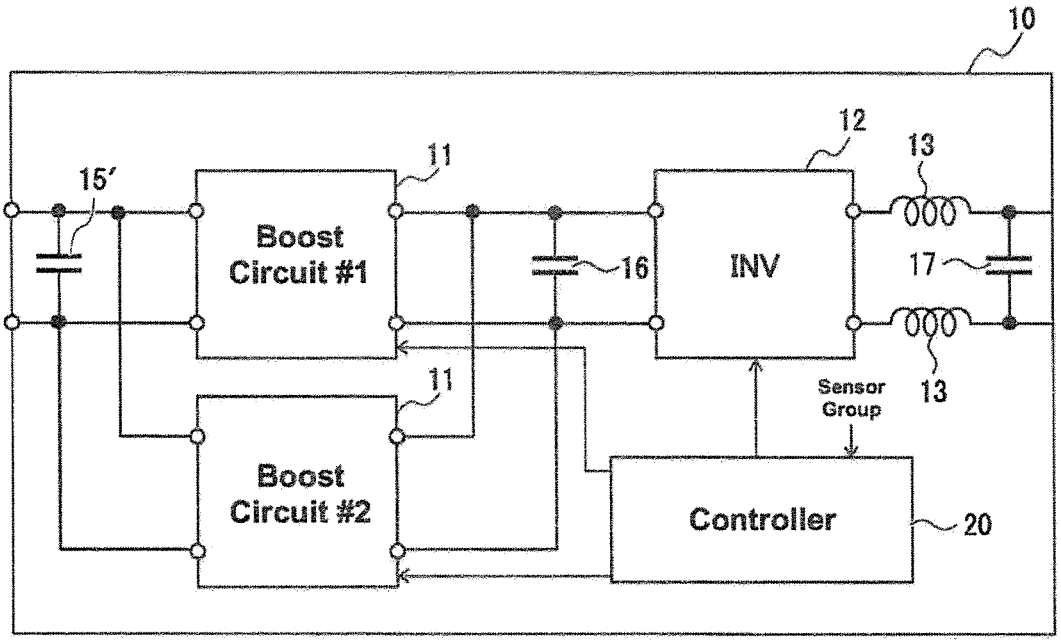
FIG. 14 is for describing an example of modifying the power converter.

The power converter 10 may be modified as illustrated in FIG. 14; namely, the power converter 10 may include a single capacitor 15' instead of including a capacitor 15 for each boost circuit 11.

The width of a pulse entering the system when changing the switching frequency (referred to below as an intermediate pulse) is between a pulse width prior to the frequency change and a pulse width after the frequency change. Therefore, the width of the intermediate pulse may differ from an average of a pulse width prior to the frequency change and a pulse width after the frequency change. The power converter 10 may be modified such that a plurality of intermediate pulses enters the system when changing the switching frequency. When the power converter 10 is modified in this manner, the pulse widths of the intermediate pulses may be configured to gradually approach the pulse width established after the frequency change.

Other information may be used instead of a power test value; for example, an input current value to a boost circuit, or an output current value from a boost circuit may be used instead of a power test value. The power converter 10 according to one or more embodiments may be modified to change only the number of operating circuits in certain cases and to change the switching frequency in other cases. For example, assuming N 4, such a power converter 10 may be configured to change the switching frequency when changing from two to three operating circuits or from three to two operating circuits and configured not to change the switching frequency in other cases. Note that such changes may be implemented by, for instance, establishing a value for each circuit frequency so that the single-circuit frequency equals the two-circuit frequency, and the three-circuit frequency equals the four-circuit frequency.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A power converter comprising: a boost unit including N boost chopper circuits connected in parallel, where N≥2; and a controller operating the boost chopper circuits within the boost unit via a PWM signal, the controller changing the number of boost chopper circuits operating and a switching frequency which is the frequency of the PWM signal in accordance with a state determination value indicating an input power value to the boost unit or an output power value from the boost unit;

when reducing the number of boost chopper circuits operating and the switching frequency the controller reduces the duty cycle of the PWM signal to a circuit to be halted while said circuit to be halted operates, whereafter the controller halts operation of said circuit to be halted and changes the switching frequency to a frequency corresponding to the state determination value.

2. The power converter according to claim 1, wherein the controller:

defines an increment threshold as a state determination value which ensures that the other boost chopper circuits that are operating do not transition from a continuous current power mode to a discontinuous current power mode even when an individual boost chopper circuit begins operating, and maintains an increment threshold separately for the number of boost chopper circuits that are operating; and changes the switching frequency to a frequency corresponding to the state determination value and begins operating a halted boost chopper circuit when the state determination value is greater than or equal to the increment threshold corresponding to the number of boost chopper circuits that are operating.

3. A power converter comprising: a boost unit including N boost chopper circuits connected in parallel, where N≥2; and a controller operating the boost chopper circuits within the boost unit via a PWM signal, the controller changing the number of boost chopper circuits operating and a switching frequency which is the frequency of the PWM signal in accordance with a state determination value indicating an input power value to the boost unit or an output power value from the boost unit; wherein the controller:

defines an increment threshold as a state determination value which ensures that the other boost chopper circuits that are operating do not transition from a continuous current power mode to a discontinuous current power mode even when an individual boost chopper circuit begins operating, and maintains an increment threshold separately for the number of boost chopper circuits that are operating; and changes the switching frequency to a frequency corresponding to the state determination value and begins operating a halted boost chopper circuit when the state determination value is greater than or equal to the increment threshold corresponding to the number of boost chopper circuits that are operating.

4. The power converter according to claim 1, wherein the controller controls the pulse width of a PWM signal prior to changing the switching frequency so that for a limited time the width of the pulse is between the pulse width of the PWM signal prior to changing the frequency and a pulse width of the PWM signal after changing the frequency.

5. A power converter according to claim 1, further comprising: an inverter for converting a direct current output from the boost unit into an alternating current.

6. The power converter according to claim 2, wherein the controller controls the pulse width of a PWM signal prior to changing the switching frequency so that for a limited time the width of the pulse is between the pulse width of the PWM signal prior to changing the frequency and a pulse width of the PWM signal after changing the frequency.

7. The power converter according to claim 3, wherein the controller controls the pulse width of a PWM signal prior to changing the switching frequency so that for a limited time the width of the pulse is between the pulse width of the PWM signal prior to changing the frequency and a pulse width of the PWM signal after changing the frequency.

* * * * *